US008360420B2

(12) United States Patent
Tsai

(10) Patent No.: US 8,360,420 B2
(45) Date of Patent: Jan. 29, 2013

(54) PAPER ADJUSTING DEVICE

(75) Inventor: Ping-Fang Tsai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/290,854

(22) Filed: Nov. 7, 2011

(65) Prior Publication Data

US 2012/0248685 A1 Oct. 4, 2012

(30) Foreign Application Priority Data

Mar. 30, 2011 (TW) ..... 100110879 A

(51) Int. Cl.
*B65H 1/00* (2006.01)
*B65H 9/00* (2006.01)

(52) U.S. Cl. ..... 271/171; 271/240; 271/248

(58) Field of Classification Search ..... 271/248, 271/240, 171
See application file for complete search history.

(56) References Cited

U.S. PATENT DOCUMENTS 3,061,303 A * 10/1962 Glaser et al. ..... 271/171
5,098,081 A * 3/1992 DeFigueiredo ..... 271/240
5,172,903 A * 12/1992 Haneda et al. ..... 271/171
5,209,467 A * 5/1993 Schmaling ..... 271/240
5,478,185 A * 12/1995 Kranz ..... 414/331.13
6,073,925 A * 6/2000 Sato ..... 271/171
6,565,080 B1 * 5/2003 Schaefer et al. ..... 271/171
8,109,505 B2 * 2/2012 Shih et al. ..... 271/223
2010/0052246 A1 * 3/2010 Sing ..... 271/171

* cited by examiner

*Primary Examiner* — Kaitlin Joerger
*Assistant Examiner* — Patrick Cicchino
(74) *Attorney, Agent, or Firm* — Altis Law Group, Inc.

(57) ABSTRACT

A paper adjusting device comprises a first and a second limiting plates; the second limiting plate substantially parallel to the first limiting plate; a first driving plate comprising a rotating end and a sliding end, the rotating end of the first driving plate is rotatably attached to the first limiting plate, and the sliding end of the first driving plate is slidably engaged with the second limiting plate; a second driving plate comprising a rotating end and a sliding end, wherein the rotating end is rotatably attached to the second limiting plate, and the sliding end is slidably engaged with the first limiting plate; and an operating member comprising a positioning plate and slidably connected to the first and the second driving plates; wherein the first and the second limiting plates, the second limiting plate are slidable to form a space to align a stack of paper.

20 Claims, 7 Drawing Sheets

PAPER ADJUSTING DEVICE

BACKGROUND

1. Technical Field

The present disclosure relates to an adjusting device, and particularly a paper adjusting device used in a printer.

2. Description of Related Art

Many printers include a paper tray. However, when a printed sheet is deposited into the paper tray after printing, the sheets of paper may often be misaligned. The sheets may need to be taken out of the paper tray and aligned manually into a stack by a user. This is laborious and inconvenient. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
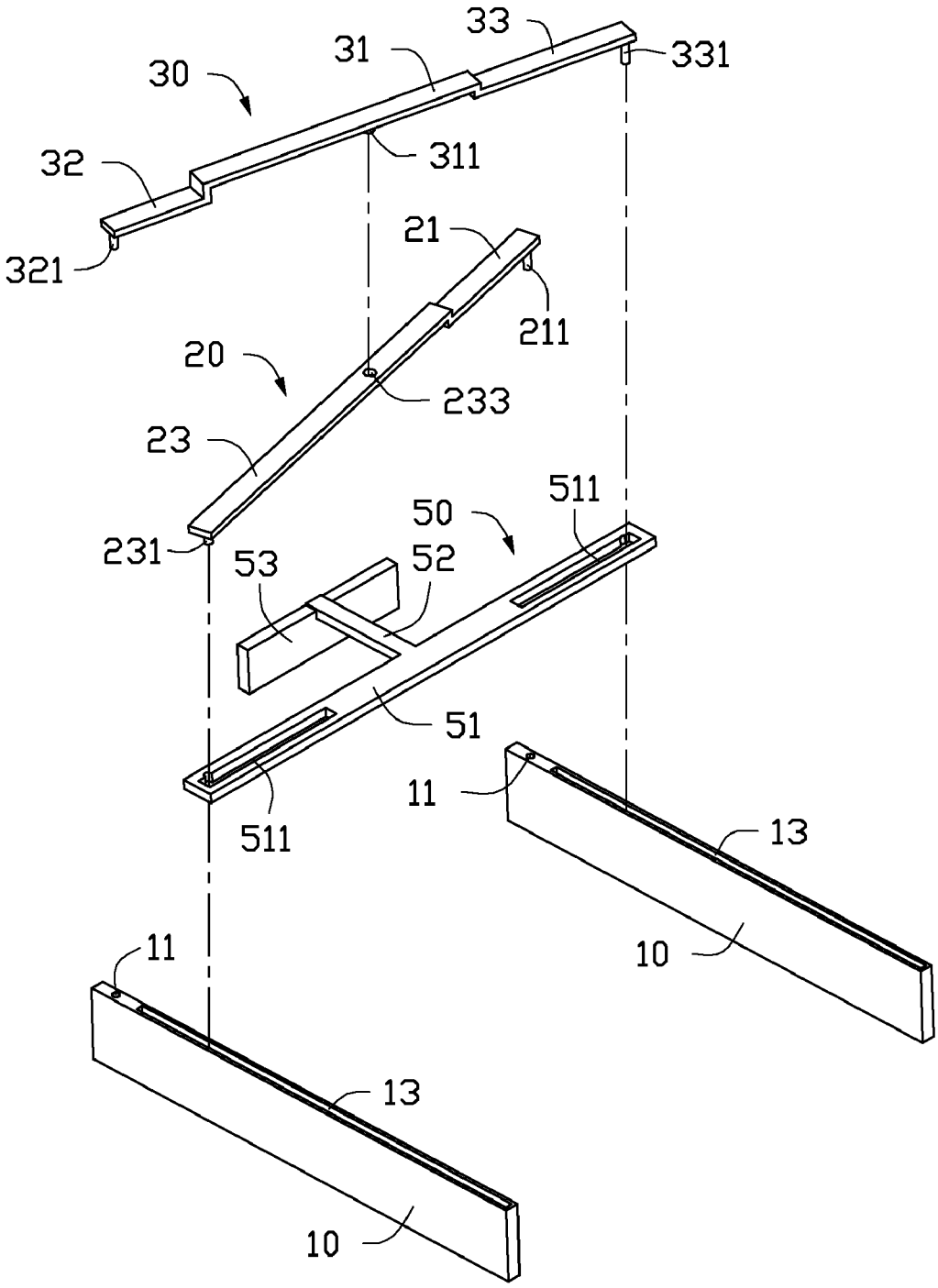
FIG. 1 is an exploded, isometric view of a paper adjusting device according to one embodiment.
Figure 2:
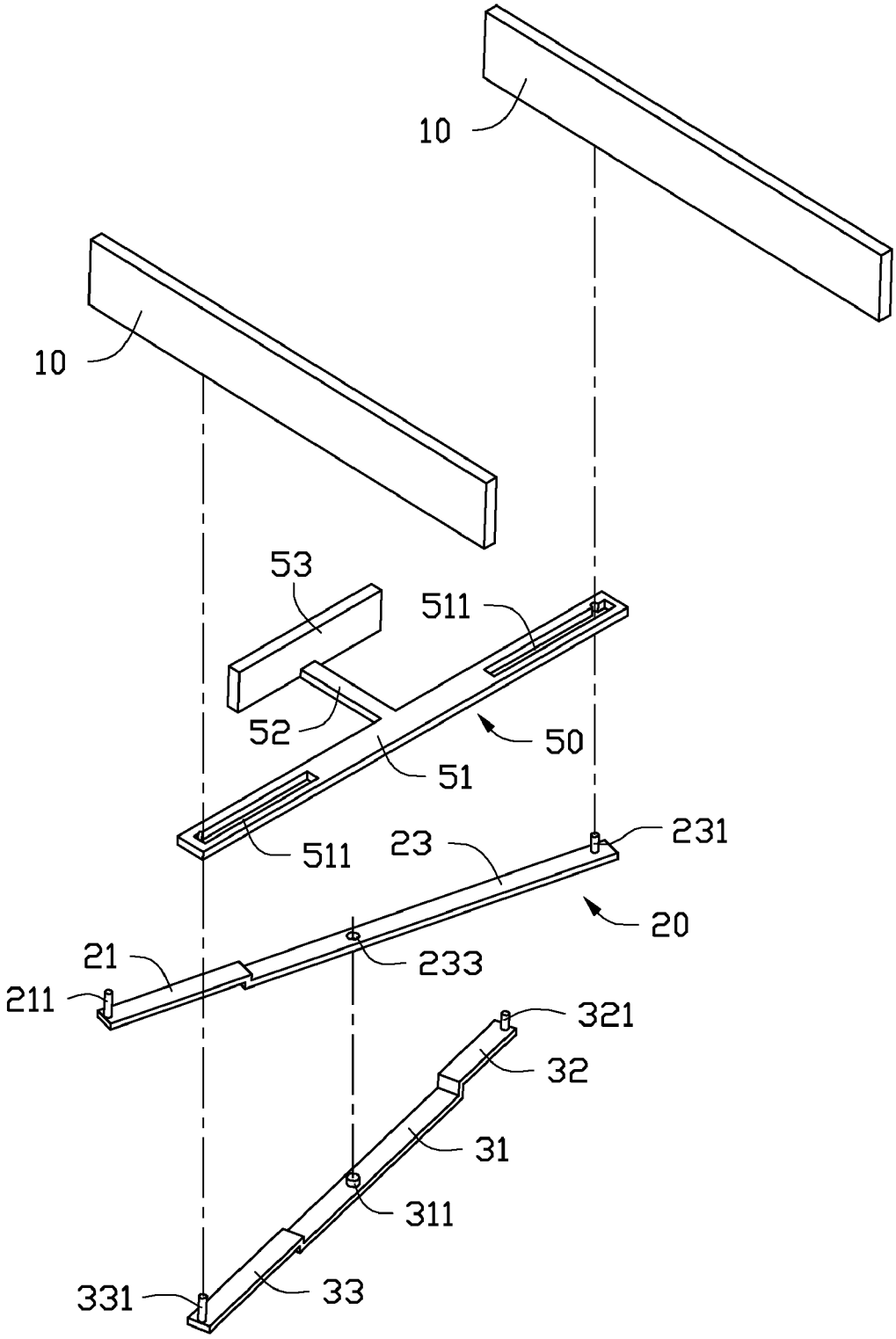
FIG. 2 is the paper adjusting device of FIG. 1 viewed from another aspect.

Referring to FIGS. 1 and 2, a paper adjusting device in accordance with an embodiment includes two limiting plates 10, a first driving plate 20, a second driving plate 30 and an operating member 50.

The bottom end of each limiting plate 10 defines a mounting hole 11 and a slot 13. The mounting hole 11 is located outside of the slot 13.

The first driving plate 20 includes a first mounting piece 21 and a first driving piece 23 connected in a stepped manner to the first mounting piece 21. In one embodiment, the first mounting piece is 21 substantially parallel to the first driving piece 23. A first mounting post 211 protrudes from the first mounting piece 21. A first sliding post 231 protrudes from the first driving piece 23, and the first driving piece 23 defines a positioning hole 233. The first mounting piece 21 and the first driving piece 23 are not coplanar.

The second driving plate 30 includes a connecting pole 31, a second mounting piece 32 and a second driving piece 33. The second mounting piece 32 and the second driving piece 33 form an extension at either end of the connecting pole 31.

In one embodiment, the connecting pole 31, the second mounting piece 32 and the second driving piece 33 are substantially parallel to each other. A pivoting post 311 protrudes from the connecting pole 31. A second mounting post 321 protrudes from the second mounting piece 32. A second sliding post 331 protrudes from the second driving piece 33. The connecting pole 31, the second mounting piece 32, and the second driving piece 33 are not coplanar, and there is a step between each element.

The operating member 50 includes a sliding plate 51, a connecting plate 52 and a positioning plate 53. The connecting plate 52 is connected to the sliding plate 51 and the positioning plate 53 and is located between the sliding plate 51 and the positioning plate 53. The sliding plate 51 and the positioning plate 53 are substantially parallel. Each end of the sliding plate 51 defines a sliding slot 511.

Figure 3:
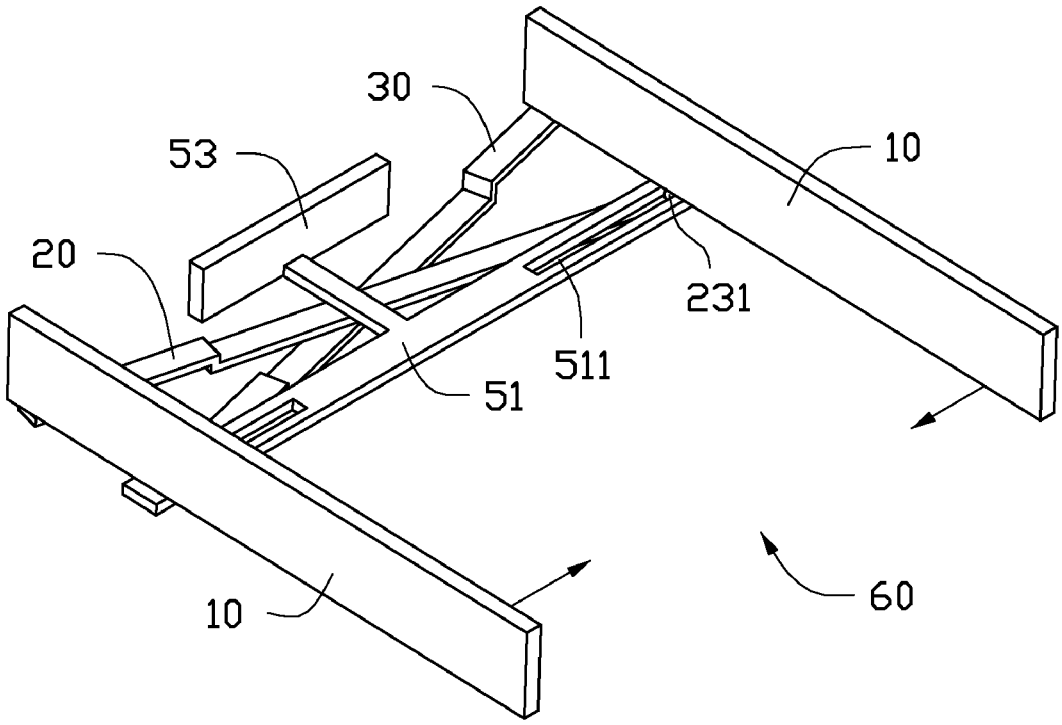
FIG. 3 is an isometric assembled view of the paper adjusting device of FIG. 2.
Figure 4:
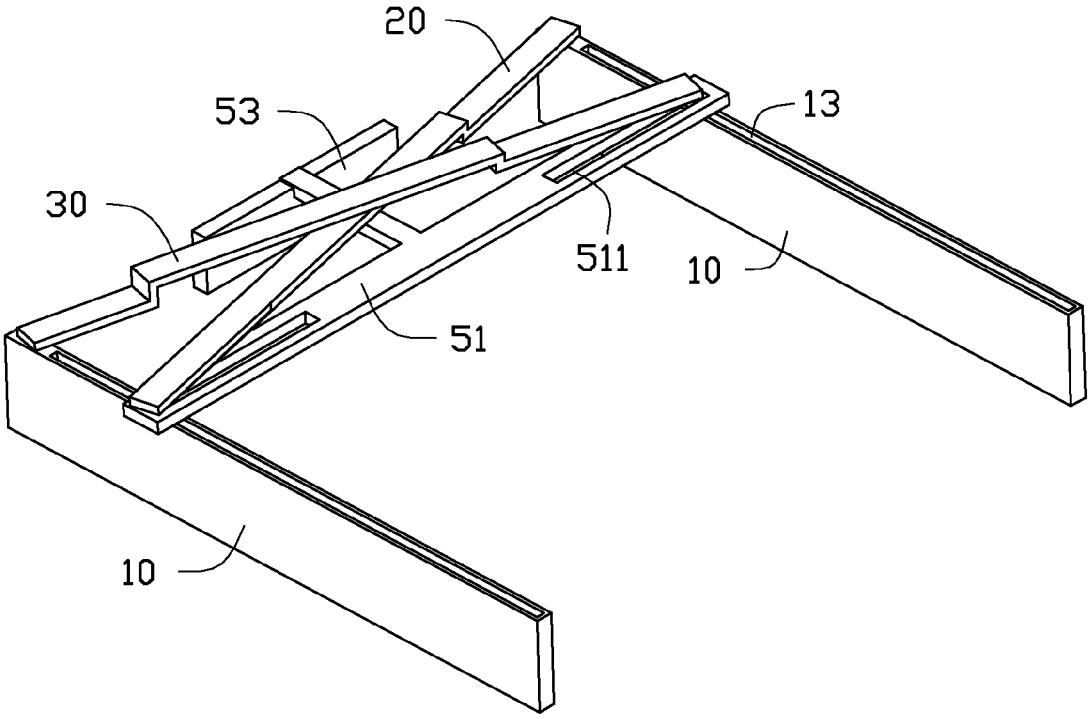
FIG. 4 is paper adjusting device of FIG. 3 viewed from another aspect.

Referring to FIGS. 3 and 4, in assembly, the pivoting post 311 is engaged in the positioning hole 233. Then the first driving plate 20 may be rotated to a certain degree relative to the second driving plate 30. The two limiting plates 10 are vertical and parallel to each other, so as to form an opening 60. The opening 60 is aligned generally to a paper outlet of a printer (not shown). The sliding plate 51 is located below the two limiting plates 10. The first driving plate 20 and the second driving plate 30 are located below the two limiting plates 10. The first mounting post 211 and the second mounting post 321 are engaged in the mounting holes 11 of the two limiting plates 10. The first sliding post 231 and the second sliding post 331 are slidably engaged in the slots 13 through the sliding slots 511 of the two limiting plates 10.

Figure 5:
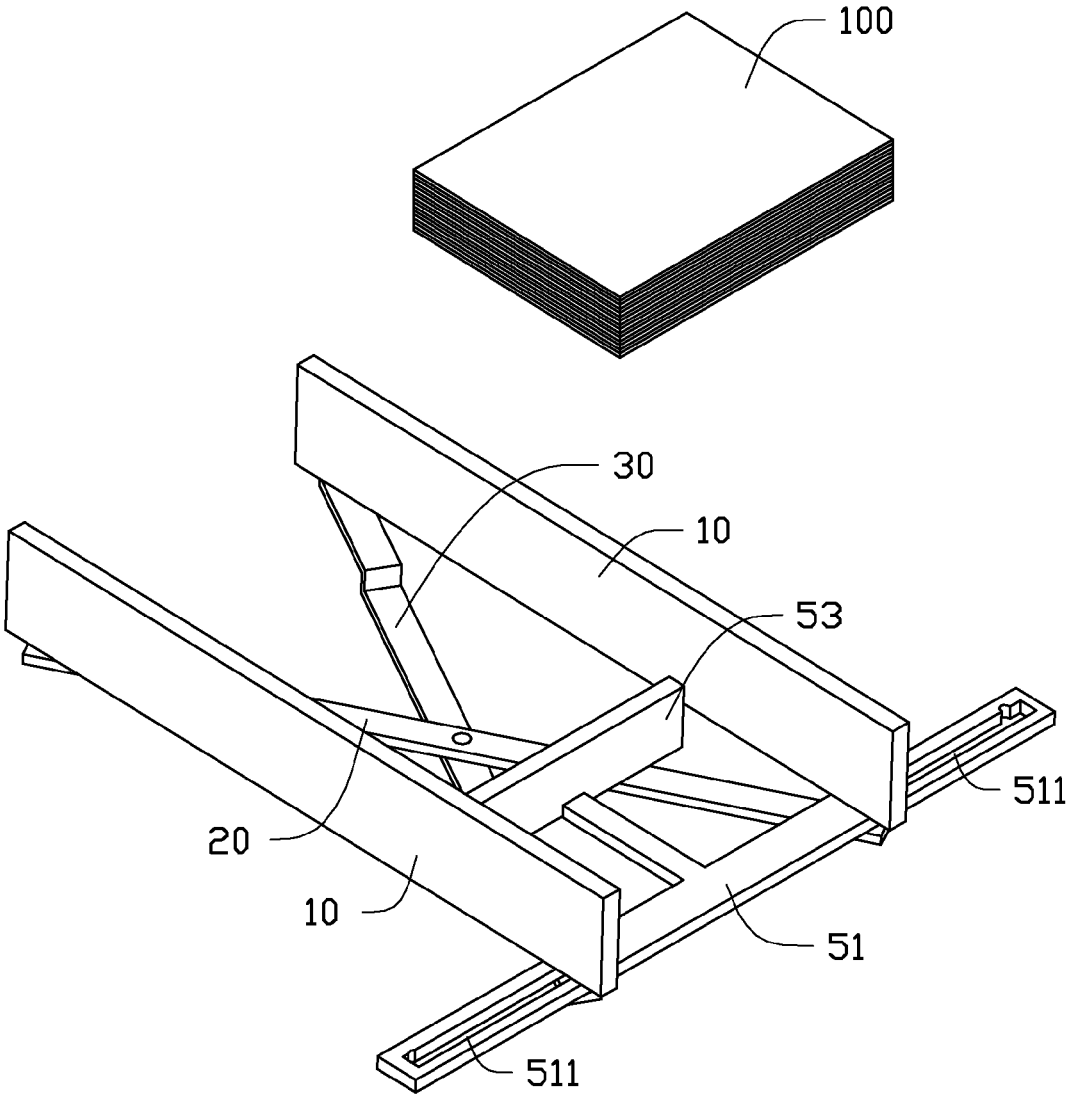
FIG. 5 is an exploded, isometric view of another embodiment of the paper adjusting device and sheets of paper.
Figure 6:
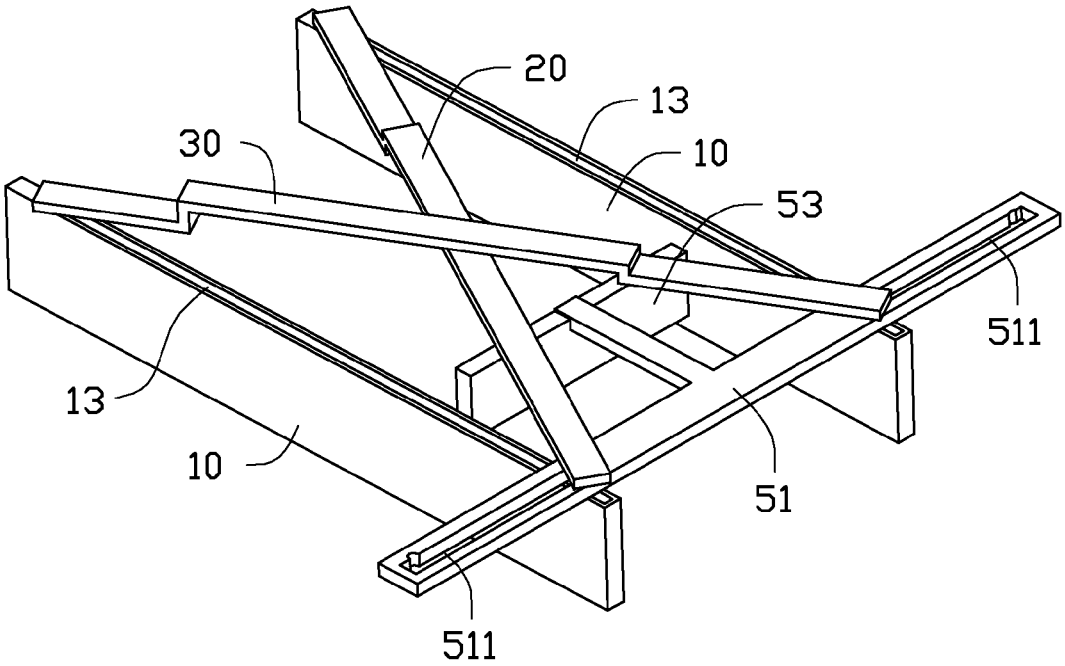
FIG. 6 is similar to FIG. 5, but viewed from another aspect and without sheets of paper.
Figure 7:
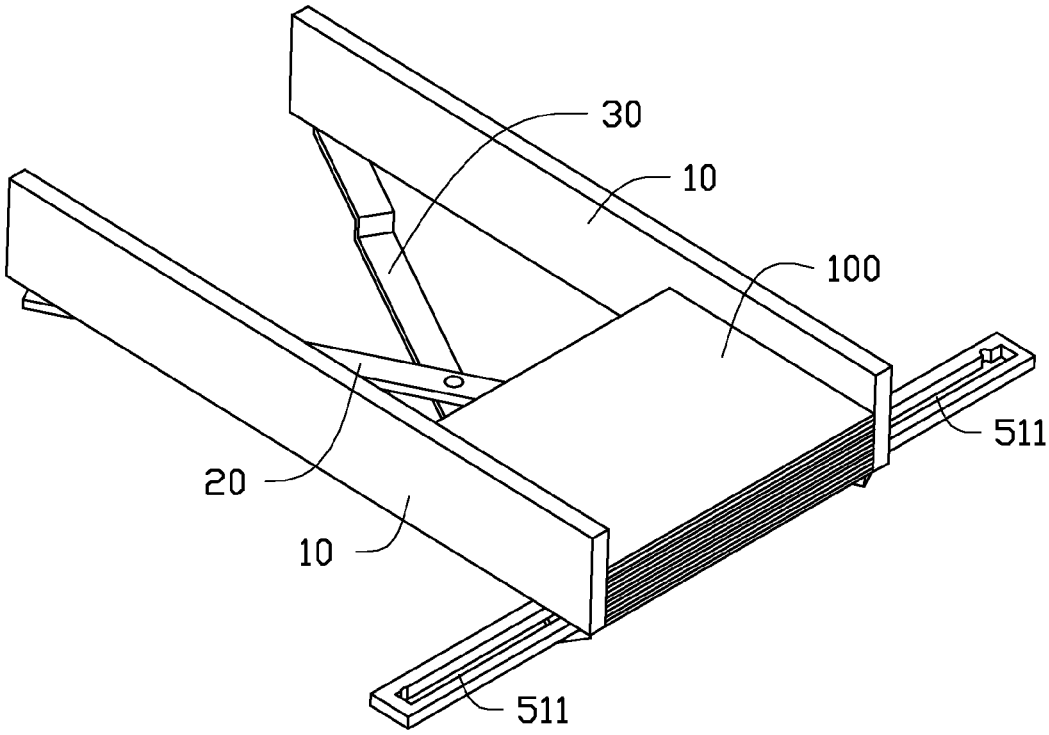
FIG. 7 is an isometric view of the assembled paper adjusting device with sheets of paper.

Referring to FIGS. 5-7, in operation, after sheets of paper 100 have been deposited in the opening 60, the two limiting plates 10 are pushed in a first direction towards each other. The first direction is substantially perpendicular to the limiting plate 10. Simultaneously, the first sliding post 231 of the first driving plate 20 and the second sliding post 331 of the second driving plate 30 slide along the slots 13 towards the opening 60. The first driving plate 20 and the second driving plate 30 push the operating member 50 along a second direction towards the opening 60. The second direction is perpendicular to the first direction. The sheets of paper 100 deposited in the opening 60 are aligned to each other when the two limiting plates 10 and the positioning plate 53 abut the edges of the papers.

The two limiting plates 10 are driven to slide opposite to the first direction, then the two limiting plates 10 drive the first driving plate 20 and the second driving plate 30 to slide away from the opening 60. The first driving plate 20 and the second driving plate 30 drive the operating member 50 to slide opposite to the second direction, until the first driving plate 20 and the second driving plate 30 are blocked by the two limiting plates 10. As a result, a neat stack of paper may be produced by the forced alignment from three sides.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

What is claimed is:

1. A paper adjusting device comprising:

a first limiting plate;

a second limiting plate substantially parallel to the first limiting plate;

a first driving plate, the first driving plate comprises a rotating end and a sliding end, the rotating end of the first driving plate is rotatably attached to the first limiting plate, and the sliding end of the first driving plate is slidably engaged with the second limiting plate;

a second driving plate, the second driving plate comprises a rotating end and a sliding end, the rotating end of the second driving plate is rotatably attached to the second limiting plate, and the sliding end of the second driving plate is slidably engaged with the first limiting plate; and an operating member comprising a positioning plate and slidably connected to the first driving plate and the second driving plate;

wherein the first limiting plate, the second limiting plate and the positioning plate are slidable to form a space to align a stack of paper.

2. The paper adjusting device of claim 1, wherein the first limiting plate is substantially parallel to the second limiting plate.

3. The paper adjusting device of claim 1, wherein the positioning plate is substantially perpendicular to the first limiting plate and the second limiting plate.

4. The paper adjusting device of claim 1, wherein the first driving plate comprises a first mounting post, and the second driving plate comprises a second mounting post; the first limiting plate defines a first mounting hole, and the second limiting plate defines a second mounting hole; the first mounting post is rotatably engaged in the first mounting hole, and the second mounting post is rotatably engaged in the second mounting hole.

5. The paper adjusting device of claim 1, wherein the first driving plate and the second driving plate cross each other at an intersection, the first and the second driving plates are rotatably engaged at the intersection.

6. The paper adjusting device of claim 1, wherein the first driving plate comprises a first sliding post, and the second driving plate comprises a second sliding post; the first limiting plate defines a first slot, and the second limiting plate defines a second slot; the first sliding post is slidably engaged in the second slot, and the second sliding post is slidably engaged in the first slot.

7. The paper adjusting device of claim 6, wherein the operating member comprises a sliding plate and a connecting plate connected to the positioning plate, the sliding plate is slidably connected to the first driving plate and the second driving plate, and the sliding plate is substantially perpendicular to the positioning plate.

8. The paper adjusting device of claim 7, wherein a first end of the sliding plate is located between the second limiting plate and the sliding end of the first driving plate, and a second end of the sliding plate opposite to the first end is located between the first limiting plate and the sliding end of the second driving plate.

9. The paper adjusting device of claim 7, wherein each of two opposite sides of the sliding plate defines a sliding slot, the first sliding post is slidably engaged in the second slot through the sliding slot of one side of the sliding plate, and the second sliding post is slidably engaged in the first slot through the sliding slot of an opposite side of the sliding plate.

10. The paper adjusting device of claim 9, wherein extending directions of the first slot and the second slot are substantially perpendicular to the first driving plate and the second driving plate.

11. A paper adjusting device comprising:

a first limiting plate;

a second limiting plate substantially parallel to the first limiting plate;

a first driving plate, the first driving plate comprises a rotating end and a sliding end, the rotating end of the first driving plate is rotatably attached to the first limiting plate, and a sliding end of the first driving plate is slidably engaged with the second limiting plate;

a second driving plate, the second driving plate comprises a rotating end and a sliding end, the rotating end of the second driving plate is rotatably attached to the second limiting plate, and the sliding end of the second driving plate is slidably engaged with the first limiting plate; and an operating member comprising a positioning plate and slidably connected to the first driving plate and the second driving plate;

wherein the first limiting plate is slidable along a first direction towards the second limiting plate to rotate the first driving plate and the second driving plate, the first driving plate and the second driving plate are slidable to slide the positioning plate along a second direction substantially perpendicular to the first direction.

12. The paper adjusting device of claim 11, wherein the first limiting plate is substantially parallel to the second limiting plate.

13. The paper adjusting device of claim 11, wherein the positioning plate is substantially perpendicular to the first limiting plate and the second limiting plate.

14. The paper adjusting device of claim 11, wherein the first driving plate comprises a first mounting post, and the second driving plate comprises a second mounting post; the first limiting plate defines a first mounting hole, and the second limiting plate defines a second mounting hole; the first mounting post is rotatably engaged in the first mounting hole, and the second mounting post is rotatably engaged in the second mounting hole.

15. The paper adjusting device of claim 11, wherein the first driving plate and the second driving plate cross each other at an intersection, and the first and the second driving plates are rotatably engaged at the intersection.

16. The paper adjusting device of claim 11, wherein the first driving plate comprises a first sliding post, and the second driving plate comprises a second sliding post; the first limiting plate defines a first slot, and the second limiting plate defines a second slot; the first sliding post is slidably engaged in the second slot, and the second sliding post is slidably engaged in the first slot.

17. The paper adjusting device of claim 16, wherein the operating member comprises a sliding plate and a connecting plate connected to the positioning plate, the sliding plate is slidably connected to the first driving plate and the second driving plate, and the sliding plate is substantially perpendicular to the positioning plate.

18. The paper adjusting device of claim 17, wherein a first end of the sliding plate is located between the second limiting plate and the sliding end of the first driving plate, and a second end of the sliding plate opposite to the first end is located between the first limiting plate and the sliding end of the second driving plate.

19. The paper adjusting device of claim 17, wherein each of two opposite sides of the sliding plate defines a sliding slot, the first sliding post is slidably engaged in the second slot through the sliding slot of one side of the sliding plate, and the second sliding post is slidably engaged in the first slot through the sliding slot of the other side of the sliding plate.

20. The paper adjusting device of claim 19, wherein extending directions of the first slot and the second slot are substantially perpendicular to the first driving plate and the second driving plate.

* * * * *